US006050352A

United States Patent [19]

Thompson

[11] Patent Number: 6,050,352

[45] Date of Patent: Apr. 18, 2000

[54] DRILLING TECHNIQUE UTILIZING DRILLING FLUIDS DIRECTED ON LOW ANGLE CUTTING FACES

[76] Inventor: Michael C. Thompson, 520 S. Ridge St., Southern Pines, N.C. 28387

[21] Appl. No.: 08/966,005

[22] Filed: Nov. 7, 1997

Related U.S. Application Data

[60] Provisional application No. 60/029,725, Nov. 8, 1996.

[51] Int. Cl.[7] ..... E21B 10/18

[52] U.S. Cl. ..... 175/69; 176/393

[58] Field of Search ..... 175/69, 57, 213, 175/393, 424

[56] References Cited

U.S. PATENT DOCUMENTS

| | | | |
|---|---|---|---|
| 1,060,929 | 5/1913 | Monberg | 175/424 X |
| 1,853,379 | 4/1932 | Rotinoff | 405/8 |
| 3,648,788 | 3/1972 | McKinney | 175/205 |
| 3,674,100 | 7/1972 | Becker | 174/69 |
| 3,841,421 | 10/1974 | Matsushita | 175/212 |
| 3,902,563 | 9/1975 | Dunn | 175/62 |
| 4,509,606 | 4/1985 | Willis | 175/69 |
| 4,723,612 | 2/1988 | Hicks | 175/393 |
| 4,793,740 | 12/1988 | Schellhorn | 405/232 |
| 5,016,717 | 5/1991 | Simons et al. | 175/66 |
| 5,115,873 | 5/1992 | Pastusek | 175/63 |
| 5,178,223 | 1/1993 | Smet | 175/425 |
| 5,305,631 | 4/1994 | Whited et al. | 73/49.2 |
| 5,339,911 | 8/1994 | Whited et al. | 175/62 |
| 5,361,855 | 11/1994 | Schuermann et al. | 175/67 |
| 5,425,429 | 6/1995 | Thompson | 175/62 |
| 5,454,435 | 10/1995 | Reinhardt | 175/19 |
| 5,622,231 | 4/1997 | Thompson | 175/77 |
| 5,653,298 | 8/1997 | Dove et al. | 175/67 |

OTHER PUBLICATIONS

"Our 50th Multi–Lateral System Installation Was An Industry Milestone", Sperry–Sun Drilling Services, Inc. 1996.

"Introducing the Gold Series", Gold Series Diamond Compact Bits, undated.

"Magnum rock bit featuring diamond–chisel gage protection", Magnum Rock Bits, undated.

Jul. 8, 1996, J. E. Akin et al., *Oil and Gas Journal,* "Asymmetric Nozzle Designs Increase Penetration Rate", pp. 42–48.

Oct. 21, 1996, *Oil and Gas Journal,* "Technology Assists in Testing, Improving Storage Tank Cathodic Protection", pp. 55, 56.

Undated, "The Corrosion Engineer's Seeing Eye", Manufacturers Literature from Corrocon, Inc.

Undated, "Retrofit Upgrades for In–Service Tanks", Bottom Logic™ UnderTank Systems, Manufacturers Literature from Corrocon, Inc.

Undated, Information on PDC bits from manufacturers of Gold Series bits (Smith Tool, Hughes Christensen, Speed Reamer, Diamond Products International).

*Primary Examiner*—Eileen Dunn Lillis
*Assistant Examiner*—Sunil Singh
*Attorney, Agent, or Firm*—John B. Phillips

[57] ABSTRACT

A method of forming boreholes using a cutting head having a low angle cutting face includes positioning orifices within the cutting head to direct pressurized streams of drilling fluid to impinge directly on the cutting face. The pressurized fluid streams clear excavated material away from the cutting face to increase the efficiency of the cutting head. In one embodiment, the orifices are positioned within the cutting face, while a second embodiment positions the orifices behind the cutting face. An alternative method provides for the stealthy formation of boreholes without disturbing the surrounding formation. The method includes positioning an orifice within the cutting head behind the cutting face to direct drilling fluid toward excavated material which has accumulated within the cutting head to a point behind the cutting face. The drilling fluid mixes with the excavated material to form a slurry while an interior pipe vacuums the slurry from the cutting head before the drilling fluid migrates to the surrounding formation.

20 Claims, 2 Drawing Sheets

DRILLING TECHNIQUE UTILIZING DRILLING FLUIDS DIRECTED ON LOW ANGLE CUTTING FACES

CROSS-REFERENCE TO CO-PENDING PROVISIONAL APPLICATION

Priority benefits are claimed under 35 U.S.C. § 119(e) of U.S. Provisional Patent Application Ser. No. 60/029,725, filed Nov. 8, 1996.

FIELD OF THE INVENTION

The present invention relates generally to methods for forming boreholes using cutting heads having low angle cutting faces and, more particularly, to using drilling fluids to alternatively clean the cutting face and create a slurry which is contained within the boundary of the cutting head.

BACKGROUND OF THE INVENTION

A cutting face of a drill bit is defined as a plane, truncated cone, or other surface positioned immediately behind the leading cutting edge of the drill bit. The cutting face structurally directs the cuttings or tailings away from the leading cutting edge of the drill bit toward a slurry point.

Two types of excavation cutting faces are classified by the angle of attack the cutting face makes with the direction of travel of the cutting head as it excavates through the formation. These two cutting face types are high angle and low angle. A high angle cutting face pushes the newly excavated cuttings ahead of the cutter, while a low angle cutting face directs the excavated material inwardly toward the return flow of drilling fluid.

Examples of high angle cutting faces can be found on currently manufactured Polycrystalline Diamond Compact (PDC) bits. Rotation of a PDC drill bit generates a spiral as the circular motion of the bit combines with the penetration of the bit along the borehole. Material which is excavated by each pass of the cutting edge accumulates ahead of the high angle cutting face where the material is compressed and pushed aside as additional material is excavated ahead of the accumulated material. Although drilling fluids injected behind the cutting face slurry the excavated material for transport away from the excavation area, a portion of the excavated material tends to become compacted in front of the high angle bit, thereby decreasing efficiency, and hence the penetration rate, of the cutter.

An example of a low angle cutting face is shown in FIG. 16 of U.S. Pat. No. 5,622,231, issued to the inventor of the present application. Further examples of low angle cutting faces are shown in FIGS. 1–3 of the present application, as described in greater detail below. As seen from these illustrations, low angle cutting faces typically terminate at an angle point where the inclined surface of the cutting face stops. In this manner, low angle cutting faces direct newly excavated material inward, toward a drilling fluid return flow, rather than pushing the excavated material ahead of the cutting face as with the above-described high angle cutting faces. An example of a drilling fluid return flow used with a low angle cutting face is shown in U.S. Pat. No. 5,622,231, which describes the use of orifices positioned behind the cutting face to direct the drilling fluid to the forward end of the borehole to slurry the soil loosened by the low angle cutting face for excavation. Typical drilling fluids may be a liquid, gas, foam, or a mixture having solids suspended in the mixture.

Low angle cutting faces are typically used in loose or unconsolidated soils, whereas high angle (rotary) drill bits are typically used in more firm or rocky soils. However, low angle cutting faces are relatively inefficient and often become clogged due to the tendency of soil to become compacted ahead of the angle point along the inclined surface of the cutting face.

Additionally, low angle cutting heads are used almost exclusively in place of high angle (rotary) cutting heads for delicate drilling operations (such as drilling a borehole immediately beneath an Aboveground Storage Tank (AST) for purposes of determining whether the AST is leaking). Low angle cutting heads are preferred for these delicate operations because they do not typically induce undesirable vibrations or impacts to the adjacent floor of the AST. However, prior low angle cutting heads (such as that shown in U.S. Pat. No. 5,622,231) direct drilling fluid ahead of the cutting face to help slurry the excavated material, and this drilling fluid tends to migrate into the surrounding formation where it can weaken the formation and present a potential hazard to the AST.

Thus, there is a need for more efficient low angle cutting heads which are less susceptible to becoming clogged due to soil compaction along the cutting face. Additionally, there is a need for improved low angle cutting heads which may be used safely for delicate drilling operations such as drilling boreholes beneath ASTs.

It is with regard to this background information that the improvements available from the present invention have evolved.

SUMMARY OF THE INVENTION

One object of the present invention is to increase the efficiency of cutting heads which utilize low angle cutting faces, thereby increasing the speed with which such a cutting head can penetrate a formation to form a borehole.

A second object of the present invention is to provide a method for forming a borehole in an unconsolidated formation without disturbing the formation around the borehole. Such a method would find particular use for investigating Aboveground Storage Tanks (ASTs) such as by drilling a borehole directly under an AST to detect leaks without disturbing the formation beneath the AST or damaging the bottom of the AST.

In one preferred embodiment, the present invention comprises a method of using a cutting head having a low angle cutting face to form either a lateral or a vertical borehole. The cutting face includes a beveled surface defined between a leading cutting edge at one end and an angle point which denotes the opposite end of the cutting face. A manifold or nozzle having at least one orifice is positioned within the cutting head and the method of the present invention includes supplying pressurized drilling fluid to the orifices to create drilling fluid streams, and directing the drilling fluid streams to impinge directly on the beveled surface of the low angle cutting face. The drilling fluid streams act to clean excavated formation material which normally accumulates on the beveled surface. Since the accumulation and compaction of the excavated material is primarily responsible for clogging the cutting head and slowing the progress of the borehole formation, the use of the drilling fluid streams to clean the cutting face increases the efficiency of the cutting head. The present invention thus distinguishes prior art cutting heads which only use drilling fluids to slurry the excavated material and not to clean the low angle cutting face.

In a first embodiment, the orifices are contained within an annular manifold which is positioned forward of the angle point along a circumference of the beveled surface. In a second embodiment, the orifices are contained within a nozzle which is positioned rearward of the angle point along a central axis of the cutting head. Thus, although positioned behind the angle point, the central location of the nozzle allows the drilling fluid streams to directly impinge the beveled surface of the cutting face.

In an alternative embodiment, the present invention comprises a method of forming a borehole in a surrounding formation without disturbing the formation immediately adjacent to the borehole. The method entails allowing the excavated material to pass over the beveled surface of the low angle cutting face before contacting the excavated material with drilling fluid to form a slurry behind the angle point which denotes the rear end of the cutting face. The slurry is then evacuated through the cutting head to the origin of the borehole to prevent the drilling fluid from migrating into the surrounding formation. In its preferred embodiment, the method uses a pair of concentric pipes positioned within the cylindrical cutting head to form three separate fluid conduits. The concentric pipes are positioned within the interior of the cutting head so that the three fluid conduits remain a distance behind the low angle cutting face. Drilling fluid and compressed air are directed through the two outer conduits to form a turbulent fluid-air mixture which mixes with the excavated material to form a slurry that is contained within the confines of the cutting head. A vacuum is then applied to the third conduit to control the pressure within the cutting head and evacuate the slurry before any drilling fluid or compressed air can escape to the surrounding formation. Additionally, provision is made for the concentric pipes to move in relation to the cutting head, thereby allowing the cutting head to be abandoned in the formation (to help prevent collapse of the borehole) while the concentric pipes are withdrawn for reuse with a new cutting head.

As noted above, the alternative embodiment may be used with ASTs or similar structures where it is desired to form a borehole under the structure without disturbing either the structure itself of the surrounding formation under the structure. In addition to checking for leaks, a borehole may be used to sample the formation material under the structure, inject sealant to close a leak in an AST, or install additional detection and monitoring devices below the AST or other structure. Thus, the present invention provides important benefits over prior art cutting heads including high angle rotary bits and pneumatic hammers which could damage an AST due to the shock and vibration which accompanies the formation of a borehole, as well as low angle cutting heads which do not provide for containing the drilling fluids used to slurry the excavated material.

A more complete appreciation of the present invention and its scope can be obtained from understanding the accompanying drawing, which is briefly summarized below, the following detailed description of presently preferred embodiments of the invention, and the appended claims.

DETAILED DESCRIPTION OF THE PREFERRED EMBODIMENTS

Figure 1:
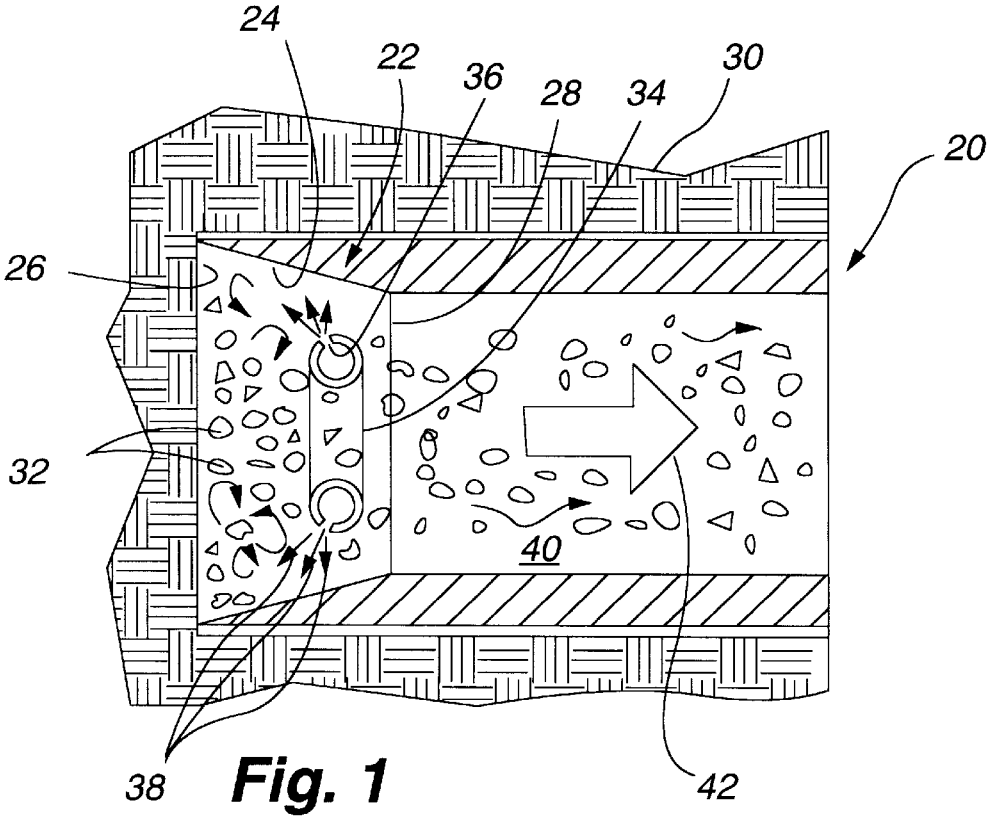
FIG. 1 is a cross-sectional view of a low angle cutting face penetrating soil in a horizontal direction and utilizing the fluid impingement technique of the present invention.

FIG. 1 illustrates a first embodiment of a low angle cutting head 20 which utilizes the direct fluid impingement technique of the present invention. The cutting head 20 includes a low angle cutting face 22 which is defined by an inclined or beveled surface 24 extending between a leading cutting edge 26 of the bit 20 and an angle point 28. As the cutting head 20 progresses through an earthen formation 30, the leading cutting edge 26 cuts the formation 30 so that the excavated material 32 is forced up the beveled surface 24 of the cutting face 22.

A drilling fluid manifold 34 is preferably positioned slightly forward of the angle point 28. The drilling fluid manifold 34 is similar to the manifold described in U.S. Pat. No. 5,622,231, and includes a number of orifices 36 for directing high pressure streams 38 of the drilling fluid. However, the manifold 34 differs from the manifold shown in U.S. Pat. No. 5,622,231 due to the placement of the manifold 34 ahead of the angle point 28 (i.e., between the angle point 28 and the leading cutting edge 26). This forward placement of the manifold 34 allows the drilling fluid streams 38 to be directed at the beveled surface 24 of the low angle cutting face 22 as opposed to simply directing the streams 38 forward to slurry the excavated material 32 as described in U.S. Pat. No. 5,622,231. The forward placement of the manifold 34 also decreases the distance the drilling fluid is required to travel to reach the beveled surface, thereby enhancing the precision of the fluid streams 38. By directing the fluid streams 38 toward the beveled surface 24 as shown in FIG. 1, the drilling fluid acts to force the newly excavated material 32 away from the cutting face 22.

The use of the fluid streams 38 to clean the cutting face 22 in this manner increases the efficiency and thus the penetration rate of the cutting head 20 by preventing the cutting head 20 from becoming clogged behind compacted excavated material 32 which would normally accumulate on the cutting face 22. Of course, once the drilling fluid streams 38 have cleaned the beveled surface 24 of the cutting face 22, the drilling fluid forms a slurry 40 with the excavated material 32. The slurry 40 is directed toward the hollow interior of the cutting head 20 and forms a return flow, represented by the arrow 42 in FIG. 1, for removing the excavated material 32 from the borehole formed in the formation 30.

Thus, the cutting head 20 and the manifold 34 differ from previously described cutting heads by directing the drilling fluid so that it directly impinges on the cutting face 22 as opposed to simply directing the fluid toward the excavated material 32 to form a return slurry. While the drilling fluid streams 38 ultimately deflect off the beveled surface 24 and mix with the excavated material 32 to form a return slurry 40, the fluid streams 38 are first beneficially used to clean the low angle cutting face 22.

Figure 2:
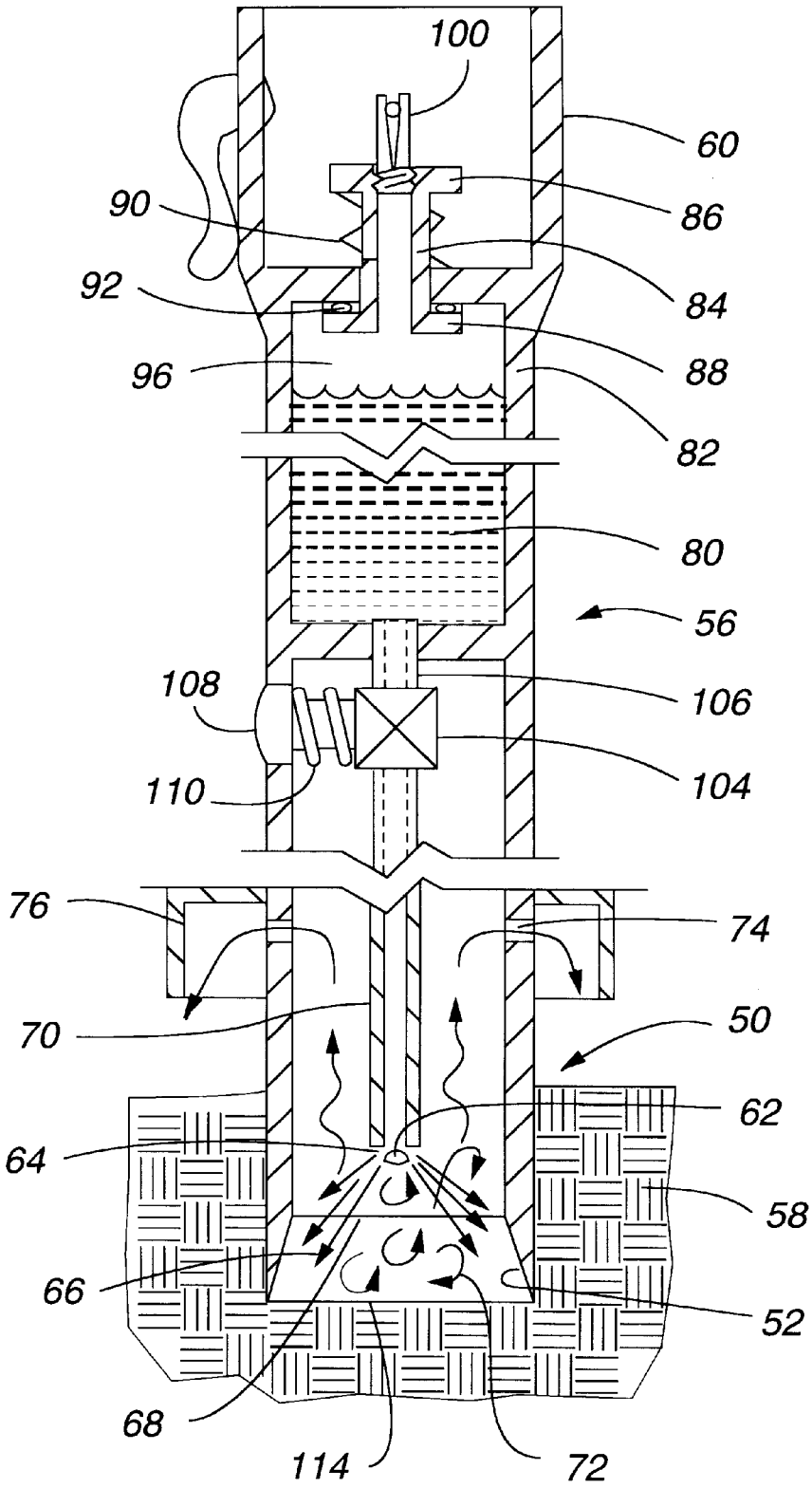
FIG. 2 is a fragmented cross-sectional view of a beach umbrella anchor with a low angle cutting surface penetrating sand in a vertical direction and utilizing the fluid impingement technique of the present invention.

FIG. 2 illustrates one particular application of the direct impingement method described above. A cutting head 50 having a low angle cutting face 52 is attached to a bottom end of a lower pole 56 of a beach umbrella which is designed to be inserted into beach sand 58 to a depth of 6–12 inches.

In its preferred embodiment, the lower pole 56 is approximately 1.25 inches in diameter and approximately 4 feet in length. An upper portion 60 of the lower pole 56 is enlarged in diameter to allow an upper pole (not shown) to telescopically extend from the lower pole 56.

Similar to the cutting head 20 shown in FIG. 1, the cutting head 50 in FIG. 2 utilizes a nozzle 62 having a plurality of orifices 64 which direct fluid streams 66 toward the interior surface of the cutting head 50 and at the low angle cutting face 52 to clean the cutting face 52 and to prevent the accumulation of sand 58 on the interior surface of the cutting head 50 as the pole 56 is inserted into the sand 58. However, unlike the manifold 34 which extends about the circumference of the cutting face 22 in FIG. 1, the nozzle 62 in FIG. 2 is positioned along the central axis of the cylindrical pole 56. In this manner, the nozzle 62 can be positioned behind (i.e., above) the angle point 68, which defines the rear or top end of the cutting face 52, while still allowing the orifices 64 to direct the fluid streams 66 toward the angled surface of the cutting face 52. By moving the nozzle 62 beyond the angle point 68, the orifices 64 are less likely to become clogged by sand as the cutting head 50 is inserted into the sand 58.

A supply tube 70 supplies the drilling fluid to the nozzle 62 in a manner described below. After the fluid streams 66 clean the sand 58 from the cutting face 52, the used drilling fluid mixes with the sand 58 to form a slurry 72. As the lower pole 56 is inserted into the sand 58, the slurry 72 is forced upward into the bottom end of the lower pole 56 past the supply tube 70. A plurality of vent holes 74 formed within the lower pole 56 allow a portion of the pressurized slurry 72 to be released to the atmosphere as the pole 56 is inserted, although much of the wet sand 58 will remain within the interior of the cutting head 50. A deflection collar 76 is preferably attached about the circumference of the pole 56 at a position slightly above the vent holes 74, as shown in FIG. 2, to deflect the slurry downward as the slurry vents through the holes 74. In this manner, the deflection collar 76 also preferably acts as a depth limiter ensuring that the pole 56 is not inserted to a depth greater than the position of the collar 76.

Because the beach umbrella illustrated in FIG. 2 must comprise a self-contained excavation device, it is necessary to provide within the lower pole 56 a means for storing the drilling fluid as well as a means for pressurizing the drilling fluid. In the preferred embodiment, the drilling fluid comprises water 80 stored within a sealed compartment 82 formed within the cylindrical lower tubing 56. A refill valve 84 extends through an opening formed in the top of the water compartment 82. The refill valve 84 includes an upper collar 86 which extends above the compartment 82 and a lower collar 88 which extends into the compartment 82. The upper collar 88 retains a coil spring 90 which tends to bias the refill valve 84 to a closed position as shown in FIG. 2. A seal 92 within the compartment 82 contacts the lower collar 88 and provides a water tight seal within the compartment 82 when the refill valve 84 is closed.

The compartment 82 may be filled with water 80 from the top end of the lower tubing 56 once the upper collar 86 is depressed to overcome the bias of the coil spring 90 and open the refill valve 84. Once the compartment 82 has been nearly filled with water as shown in FIG. 2, compressed air may be added to an air chamber 96 extending above the level of the water 80. An air control valve 100 preferably extends from the top of the refill valve 84 and provides access through the refill valve 84 to the air chamber 96 within the compartment 82. The air control valve is preferably accessible by standard air chucks for charging the air chamber 96 with pressurized air. Once the air chamber 96 is charged, the pressurized air cooperates with the coil spring 90 to maintain the lower collar 88 pressed against the seal 92, thereby preventing the water 80 from leaking from the compartment 82.

An upper end of the supply tube 70 extends into the bottom of a release valve 104, while a second supply tube 106 extends from the top of the release valve 104 to the bottom of the compartment 82 as shown in FIG. 2. The release valve 104 includes a button 108 extending to the exterior of the tubing 56, and a coil spring 110 tends to bias the button 108 to a position where release valve 104 is closed. Thus, once the compartment 82 has been charged with water 80 and pressurized air, a user may depress the button 108 to open the release valve 104 and allow the pressurized water (i.e., the drilling fluid) to pass through the supply tubes 106 and 70 and exit the orifices 64 of the nozzle 62, as described above. Therefore, as the user begins to push a leading cutting edge 114 of the cutting head 50 into the sand 58, the user preferably depresses the button 108 to allow the pressurized water streams 66 to be directed at the cutting face 52 of the cutting head 50. As described above, the streams 66 tend to clean the cutting face 52 as the cutting edge 114 penetrates the sand 58, thereby preventing compaction of the sand within the cutting head 50 and enhancing the ease with which the cutting head 50 is inserted into the sand 58.

Figure 3:
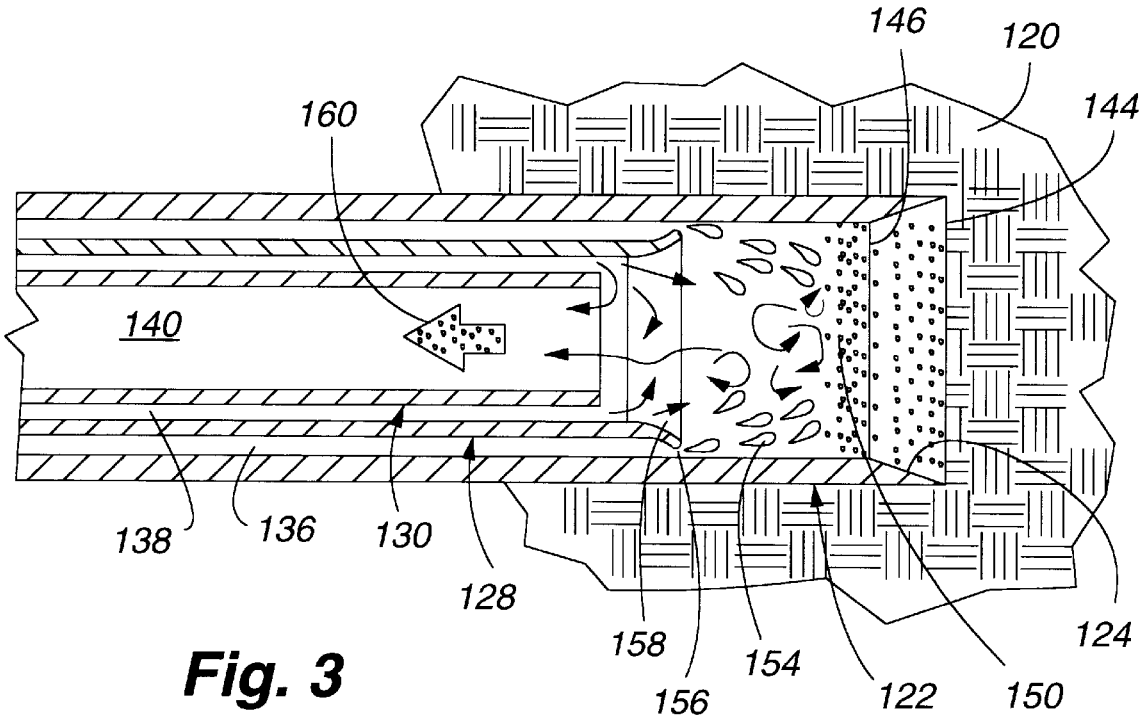
FIG. 3 is cross-sectional view of an alternative embodiment of a low angle cutting face which utilizes drilling fluid to slurry the excavated material while preventing the drilling fluid from migrating into the surrounding formation.

FIG. 3 illustrates an alternative embodiment of the cutting head shown in FIGS. 1 and 2 for use in situations where it is desirable to prevent drilling fluid from migrating into the formation 120. While the cutting heads 20 and 50 in FIGS. 1 and 2 utilize drilling fluid streams directed at the respective cutting faces 22 and 52 to clean the cutting faces and enhance the efficiency of the cutting heads, no provision is made with these cutting heads 20 and 50 to contain the used drilling fluid. Thus, although a majority of the drilling fluid is directed back through the interior of the cutting heads 20 and 50 (as a slurry with the excavated material), a portion of the drilling fluid typically escapes to the surrounding material where it may weaken the formation surrounding the cutting head.

Thus, the cutting head 122 in FIG. 3 does not direct drilling fluid at its cutting face 124, but rather utilizes a series of three annular conduits to create a slurry within the confines of the cutting head 122 and then suction that slurry away before any drilling fluid escapes into the surrounding formation. Towards this end, the cutting head 122 includes within its cylindrical interior two concentric pipes consisting of an outer pipe 128 and an inner pipe 130. The combination of the cylindrical cutting head 122 and the two pipes 128 and 130 forms three concentric annular conduits: a first conduit 136 defined between the inner wall of the cutting head 122 and the outer wall of the outer pipe 128; a second conduit 138 defined between the inner wall of the outer pipe 128 and the outer wall of the inner pipe 130; and a third conduit 140 defined within the interior of the inner pipe 130.

As shown in FIG. 3, a leading cutting edge 144 of the cutting head 122 directs the loosely compacted formation material past the cutting face 124 and into the interior of the cutting head 122. The compacted formation material preferably extends within the cutting head 122 so that a material boundary 150 is positioned beyond the angle point 146 which denotes the rear limit of the cutting face 124.

In order to create a slurry within the interior of the cutting head 122, drilling fluid 154 is preferably pumped through the first conduit 136 where it is passes through an orifice 156 formed between a flared end 158 of the outer pipe 128 and the interior surface of the cutting head 122. The drilling fluid 154 expelled from the orifice 156 preferably mixes with vent or compressed air from the second conduit 138 to form a turbulent fluid-air mixture which is directed toward the material boundary 150. The turbulent fluid-air mixture thus mixes with the excavated formation material at the boundary 150 to form a slurry 160 which is directed to the third conduit 140 (i.e., the interior of the inner pipe 130) by the application of a partial vacuum to the third conduit 140. Additionally, the cross-sectional area of the third conduit 140 (i.e., the inside diameter of the inner pipe 130) is relatively large to help prevent clogging of the conduit 140 by permitting passage of large pieces of the excavated formation material 120.

The cutting head 122 can thus be used in a variety of situations where it is imperative to form a borehole without disturbing the surrounding formation 120. For example, the cutting head 122 may be extended beneath an Aboveground Storage Tank ("AST") without loosening the formation 120 adjacent to the cutting head 122. Furthermore, to prevent the borehole from collapsing, the cutting head 122 may be left behind in the borehole while the outer and inner pipes 128 and 130, respectively, may be withdrawn from the cutting head 122 upon completion of the borehole.

Of course, care must be taken to regulate the pressure of both the supply and the return conduits (136, 138 and 140) to prevent infiltration of the drilling fluid into the formation. Additionally, the supply and return pressures must also be properly controlled to prevent overpressures resulting in blowouts into the formation or underpressures leading to a collapse of the borehole.

Presently preferred embodiments of the present invention have been described with a degree of particularity. These descriptions have been made by way of preferred example and are based on a present understanding of knowledge available regarding the invention. It should be understood, however, that the scope of the present invention is defined by the following claims, and not necessarily by the detailed description of the preferred embodiments.

The invention claimed is:

1. A method of cleaning a low angle cutting face of a cutting head attached to one end of a self-contained excavation device, the cutting head having a substantially cylindrical shape with a hollow interior, and the low angle cutting face having a leading cutting edge and a beveled surface for directing excavated material toward the hollow interior of the cutting head during penetration of the cutting head into a surrounding formation to form a borehole, said method comprising the steps of:

storing drilling fluid within a compartment of the self-contained excavation device;

pressurizing the drilling fluid stored within the compartment;

transferring the pressurized drilling fluid to an orifice positioned within the cutting head; and directing the drilling fluid from the orifice toward the low angle cutting face as the cutting head penetrates the surrounding formation to clear the excavated formation material from the beveled surface of the low angle cutting face.

2. A method as defined in claim 1 wherein the drilling fluid is water.

3. A method as defined in claim 2 wherein the surrounding formation is sand.

4. A method as defined in claim 3 wherein the self-contained excavation device is a beach umbrella stand.

5. A method as defined in claim 1, wherein the low angle cutting face extends between the leading cutting edge and an angle point to the rear of the leading cutting edge, said method further comprising the step of:

positioning the orifice between the leading cutting edge and the angle point.

6. A method as defined in claim 5 wherein the low angle cutting face has a substantially annular cross section, said method further comprising the steps of:

forming the orifice within an annular manifold; and positioning the annular manifold along a circumference of the low angle cutting face.

7. A method as defined in claim 1, wherein the low angle cutting face extends between the leading cutting edge and an angle point to the rear of the leading cutting edge, said method further comprising the step of:

positioning the orifice to the rear of the angle point.

8. A method as defined in claim 7, wherein the orifice is defined within a nozzle positioned along a central axis of the substantially cylindrical cutting head.

9. A method as defined in claim 1 further comprising the steps of:

mixing the drilling fluid with the excavated material to form a slurry; and directing the slurry into the hollow interior of the cutting head to remove the slurry from the borehole.

10. A method of using a cutting head to form a borehole in a formation without disturbing the formation adjacent to the borehole, said cutting head having a low angle cutting face and a substantially cylindrical shape with a hollow interior, and said low angle cutting face having a beveled surface and a leading cutting edge for directing excavated formation material into the hollow interior of the cutting head, said method comprising the steps of:

supplying drilling fluid to an orifice positioned within the cutting head to the rear of the low angle cutting face;

directing the drilling fluid from the orifice toward a boundary point of the excavated formation material that extends within the hollow interior of the cutting head to the rear of the leading cutting edge;

mixing the drilling fluid with the excavated formation material to form a slurry at the boundary point; and applying a partial vacuum to a first end of an inner pipe extending within the hollow interior of the cutting head to suction the slurry through a second end of the inner pipe and prevent the slurry from migrating beyond the leading cutting edge of the low angle cutting face.

11. A method as defined in claim 10, wherein the inner pipe has a diameter smaller than a diameter of the cylindrical cutting head and is positioned concentrically within the hollow interior of the cutting head, and wherein the step of supplying drilling fluid to the orifice further comprises:

pressurizing the drilling fluid between an exterior surface of the inner pipe and an interior surface of the cutting head, wherein the orifice is defined by an annular region between the second end of the inner pipe and the interior surface of the cutting head.

12. A method as defined in claim 11, further comprising the step of:

abandoning the cutting head within the borehole following the formation of the borehole to prevent the borehole from collapsing and disturbing the adjacent formation.

13. A method as defined in claim 12, further comprising the step of:

withdrawing the inner pipe from the hollow interior of the cutting head.

14. A method as defined in claim 10 wherein the drilling fluid is supplied to the orifice through a first conduit, said method further comprising the steps of:

supplying air through a second conduit positioned within the cutting head to the rear of the low angle cutting face;

directing the air from the second conduit toward the excavated formation material that extends within the hollow interior of the cutting head; and mixing the air with the drilling fluid from the orifice to form a turbulent fluid-air mixture to enhance mixing the drilling fluid with the excavated formation material.

15. A method as defined in claim 14, wherein the inner pipe has a diameter smaller than a diameter of the cylindrical cutting head and is positioned concentrically within the hollow interior of the cutting head, said method further comprising the steps of:

forming the second conduit between an exterior surface of the inner pipe and an interior surface of an outer pipe, said outer pipe having a diameter which is larger than the diameter of the inner pipe and smaller than the diameter of the cylindrical cutting head, and said outer pipe being positioned concentrically between the cutting head and the inner pipe; and forming the first conduit between an exterior surface of the outer pipe and an interior surface of the cutting head, wherein the orifice is defined by an annular region between an end of the outer pipe and the interior surface of the cutting head.

16. A method as defined in claim 15, further comprising the step of:

abandoning the cutting head within the borehole following the formation of the borehole to prevent the borehole from collapsing and disturbing the adjacent formation.

17. A method as defined in claim 16, further comprising the step of:

withdrawing the inner and outer pipes from the hollow interior of the cutting head.

18. A method as defined in claim 10, wherein the borehole is formed beneath an aboveground storage tank.

19. A method of cleaning a low angle cutting face attached to one end of a self-contained excavation device, the low angle cutting face having a leading cutting edge and a beveled surface for directing excavated material to the rear of the leading cutting edge during penetration of the leading cutting edge into a surrounding formation, said method comprising the steps of:

storing drilling fluid within a compartment of the self-contained excavation device;

pressurizing the drilling fluid stored within the compartment;

transferring the pressurized drilling fluid to an orifice positioned to the rear of the leading cutting edge; and directing the drilling fluid from the orifice toward the low angle cutting face as the leading cutting edge penetrates the surrounding formation to clear the excavated formation material from the beveled surface of the low angle cutting face.

20. A method as defined in claim 19 wherein the self-contained excavation device is a beach umbrella stand.

* * * * *